United States Patent [19]

Kinney, III

[11] Patent Number: 4,725,062

[45] Date of Patent: Feb. 16, 1988

[54] WOOD-TYPE GOLF CLUB HEAD

[76] Inventor: Robert D. Kinney, III, 30 Ravensworth, Conroe, Tex. 77302

[21] Appl. No.: 862,259

[22] Filed: May 12, 1986

[51] Int. Cl.[4] ..... A63B 53/04

[52] U.S. Cl. ..... 273/175; 273/80 C

[58] Field of Search ..... 273/80.7, 169, 175, 273/167 C, 167 D, 167 E, 167 F, 173, 174, 171, 172

[56] References Cited

U.S. PATENT DOCUMENTS

| | | | |
|---|---|---|---|
| 682,960 | 9/1901 | Slazenger | 273/80.7 |
| 1,064,916 | 6/1913 | Kelly et al. | 273/169 |
| 2,076,340 | 4/1937 | Hadden | 273/80.1 |
| 2,395,837 | 3/1946 | Baymiller et al. | 273/175 |
| 4,471,961 | 9/1984 | Masghati et al. | 273/175 |

*Primary Examiner*—George J. Marlo

*Attorney, Agent, or Firm*—Dodge, Bush & Moseley

[57] ABSTRACT

A wood-type golf club head has a spherical body with an arm extending radially outward thereof. The arm is bored to receive the shaft whereby the axis of the shaft passes through the center of the body. The hitting face of the body is formed with vertical roll and horizontal bulge. The vertical roll is defined by an arc having a radius of 4.75 inches centered at a point (50) located within the club head. The horizontal bulge is defined by an arc having a radius of 6 inches centered on a point (46) located outside the club head.

11 Claims, 8 Drawing Figures

FIG. 1A
(PRIOR ART)
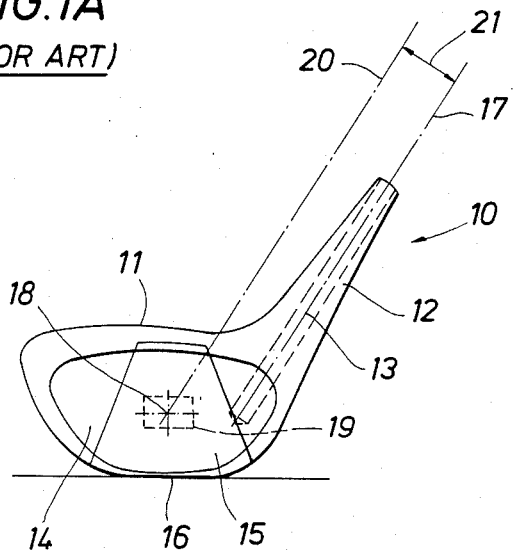
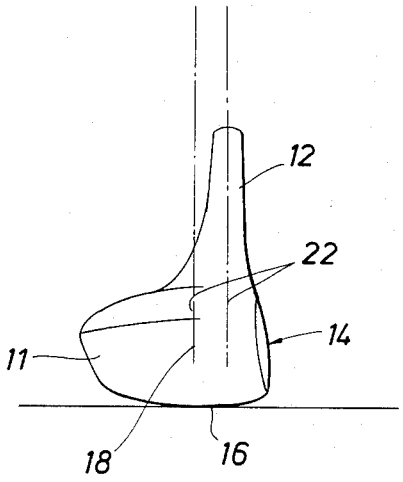
FIG. 1B
(PRIOR ART)
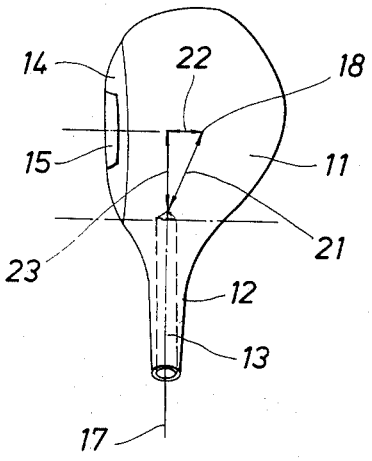
FIG. 1C
(PRIOR ART)
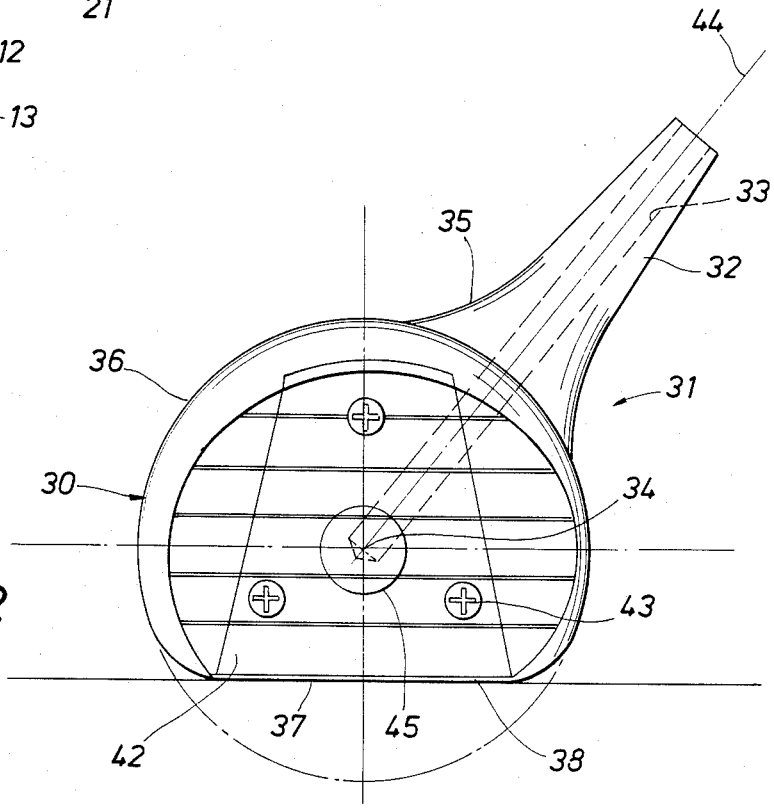
FIG. 2

FIG. 5
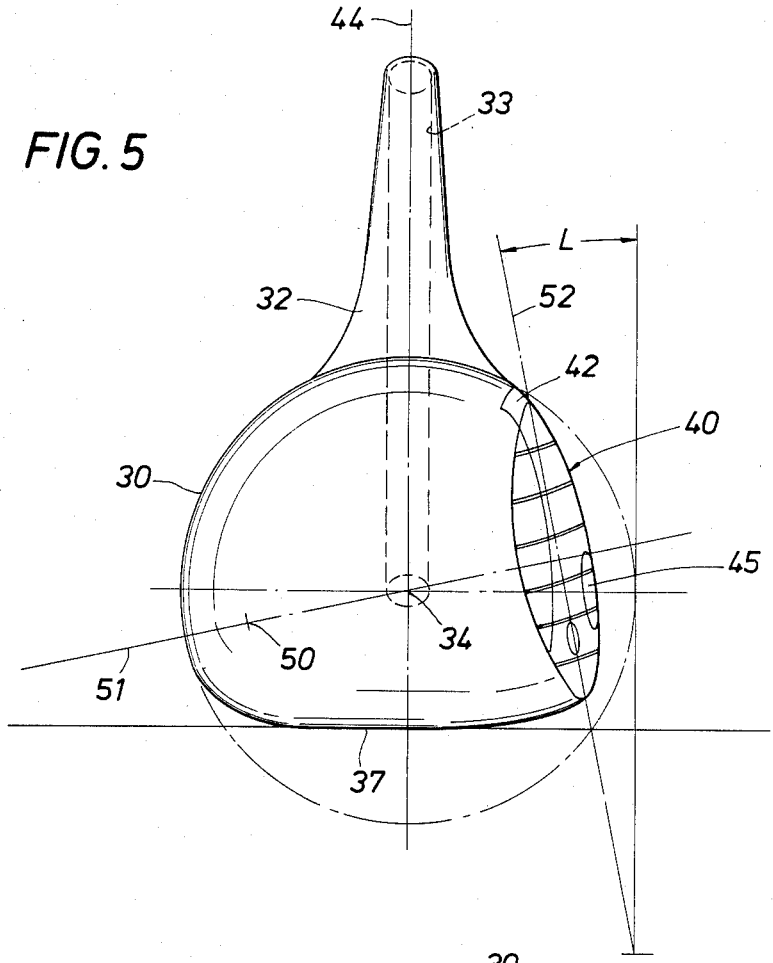
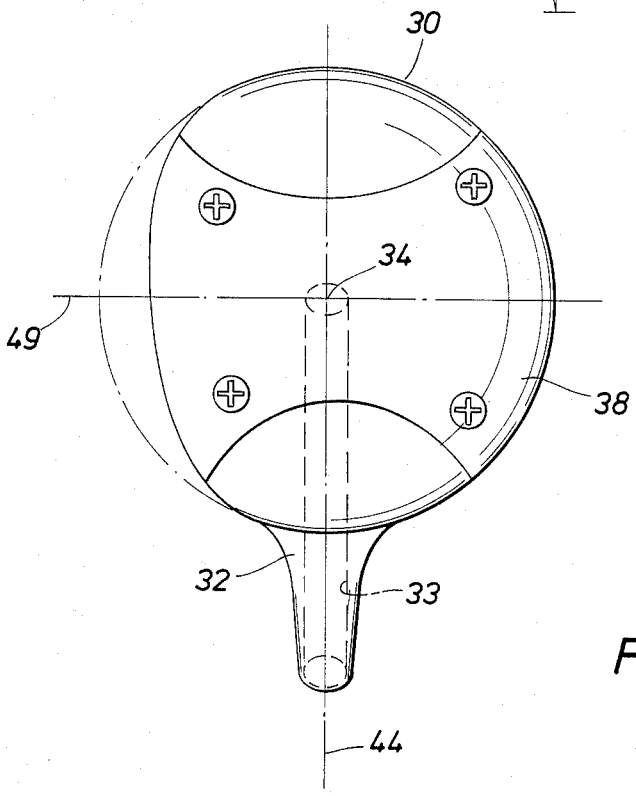
FIG. 6

WOOD-TYPE GOLF CLUB HEAD

FIELD OF THE INVENTION

This invention relates generally to a golf club head for woods, and particularly to a new and improved head design for a wood having no offset and a hitting face with an extreme bulge which provides for more accurate golf shots.

BACKGROUND OF THE INVENTION

A typical golf club "wood" has a pear-shaped head that is attached to a shaft. The front face of the head is flat or only slightly bulged, and usually has a plastic insert that provides the hitting surface. A central rectangular region of the front face of the insert which lies directly ahead of the center of mass of the head defines its "sweet spot". If one were to draw an imaginary line that is parallel to the axis of the shaft and which passes through the center of mass of the head, there is a substantial offset distance between this line and the longitudinal axis of the shaft. Not only is the line offset toward the toe of the club head, the line also is offset toward the rear of the shaft.

The offset design of a conventional club head causes problems that continue to frustrate even the most skilled golfers. The offset between the sweet spot and the shaft axis provides a built-in moment arm between the impact point with the golf ball and the shaft which dictates that if such moment arm is not precisely perpendicular to the arc of club movement at the instant of impact, but is at an angle with respect thereto, something generally undesirable may happen to the flight of the ball. The shot can be a slice or a hook, depending upon whether the angle is negative (club face "open") or positive (club face "closed"). Although skilled golfers will occasionally deliberately slice or hook the ball in order to cause the ball to fly around an obstruction between them and the pin, or for other reasons, in most cases a slice or hook shot is inadvertent, and indeed unfortunate as those skilled in the art will recognize.

Another shortcoming of the conventional wood club head design is related to the fact that the hitting face and insert, as mentioned above, provide a relatively flat surface. Where the arc of the swing is not precisely on line with the direction in which the golfer wants the ball to go, the resulting shot can be "pushed" to the right of, or "pulled" to the left of, the desired line of flight. Since the hitting surface is substantially flat, the ball necessarily responds to the direction in which the club head is moving, even assuming that the face is neither open nor closed as described above. Thus the typical club head is unforgiving in circumstances where the swing of the golfer results in an arc of movement of the club head that is not exactly on line with the desired general direction of ball flight at the instant of impact with the ball.

The general object of the present invention is to provide a new and improved wood-type club head design which minimizes, if not alleviates altogether, the foregoing problems with prior club head designs.

Another object of the present invention is to provide a new and improved wood-type club head design in which the axis of the shaft passes through the center of mass of the head to provide vastly improved golf shots.

Still another object of the present invention is to provide a new and improved wood-type club head having an extreme outwardly bulge of the hitting face that functions to accommodate imperfections in the arc of a golfer's swing that would otherwise result in a pushed or pulled golf shot.

SUMMARY OF THE INVENTION

These and other objects are attained in accordance with the present invention through the provision of a unique club head design. The head is formed with a body having the initial approximate shape of a sphere, and with an arm extending outwardly on one side. The arm is bored out to receive the lower end portion of the shaft, whereby the axial centerline of the shaft passes through the geometrical center of the spherical body, and thus through its center of mass. A sole surface is formed on the body in a plane with respect to the shaft centerline that depends on certain physical aspects of the golfer, but typically is about 50°.

Next the hitting face of the head is formed by removing a portion of the front of the spherical body, with this face being initially planar or flat and having an angle with respect to horizontal that determines the loft of the ball (and the number of the club, i.e., 1–7 for example). A recess is formed to receive the insert, and then the actual shape of the hitting face is formed in accordance with another aspect of the present invention. In accordance with this feature, a relatively severe facial bulge is provided that may be considered to be the combination of two curves, one providing what may be called the vertical roll, and the other the horizontal bulge. With respect to conventional values of these parameters, the horizontal bulge is increased by approximately 30°, and the vertical roll by approximately 70°. The result is a club face with extreme roundness compared to other drivers. Applicant has found that a club head formed in accordance with the present invention provides a remarkable improvement in accuracy of golf shots, and believes that such results are due to the following unique aspects of this invention. Since the axis of the shaft passes through the approximate center of mass of the body of the club head, so that there is no offset, instances of inadvertently sliced or hooked shots are greatly reduced. The severe roundness of the hitting face compared to prior designs greatly reduces the instances of pushed or pulled shot where the arc of club movement is not perfectly in line with the desired line of flight of the ball.

BRIEF DESCRIPTION OF THE DRAWINGS

The present invention has other objects, features and advantages that will become more clearly apparent in connection with the following detailed description of a preferred embodiment, taken in conjunction with the appended drawings in which:

FIGS. 1A–1C, labeled Prior Art, show a wood club head and shaft connection of conventional design;

FIG. 2 is a frontal view of the club head of the present invention;

FIG. 5 is a side view looking at the present club head design from the toe; and FIG. 6 is a bottom view.

DETAILED DESCRIPTION OF A PREFERRED EMBODIMENT

Figure 3:
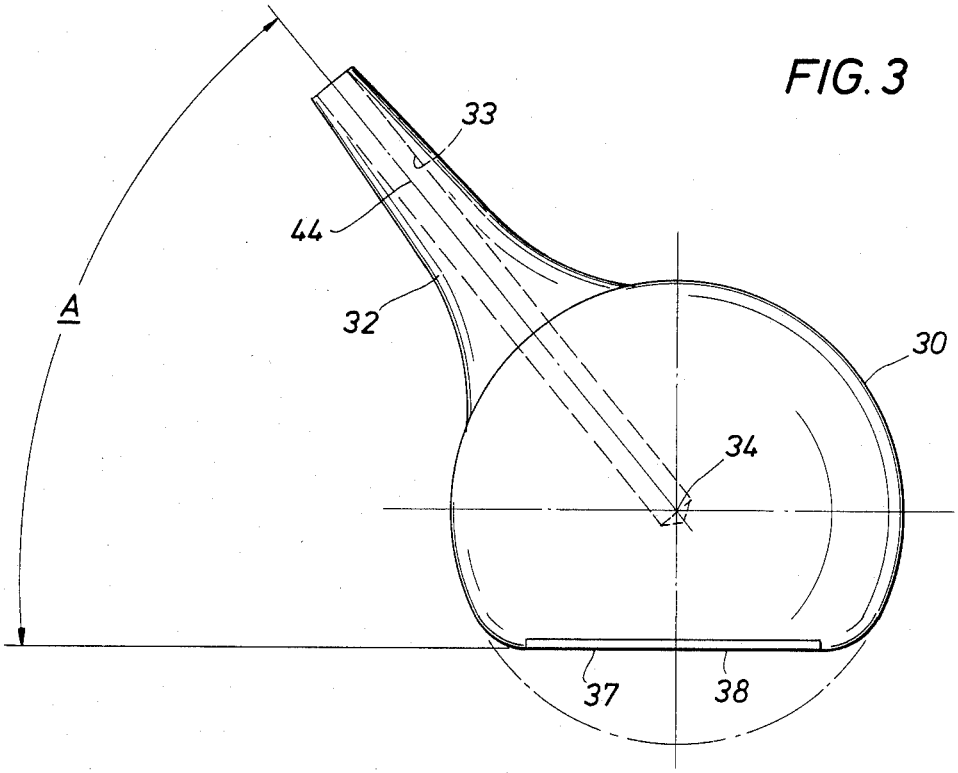
FIG. 3 is a rear view of the club head of the present invention.

Referring initially of FIGS. 1A–1B, the overall shape of a prior art "wood" club head 10, typically used by a golfer as a driver, is shown. Although the term "wood" is used extensively herein, a driver may be made of an actual natural wood such as persimmon, a processed natural wood such as a laminate or plywood of maple, a synthetic material such as an injection molded plastic, or even a metal such as aluminum. The typical club head 10 has a pear-shaped body 11 and a neck or hosel 12. The neck 12 is bored at 13 to receive the lower end portion of a shaft (not shown). The front face 14 is generally planar, and is recessed to receive an insert 15 which defines the hitting area of the club head. Insert 15 can be made of various materials such as plastic compositions, stainless steel or aluminum. The bottom surface 16 of the head is flattened to provide a region for a sole plate, usually made of metal, with the surface 16 lying in a horizontal plane that has an angle with respect to the axial centerline 17 of the shaft bore 13 that is dependent upon various physical aspects of the golfer such as height and arm length, but typically is about 50°.

The center of mass of the typical club head is indicated as point 18 in FIGS. 1A–1C, and as viewed from the front in FIG. 1A, lies directly behind the approximate center of the insert 15. A relatively small region 19 shown in dotted lines represents the sweet spot of the club face, so that when the golfer is able to swing such that this region encounters the ball, the club seems to be the most responsive. As those skilled in the art will recognize, the sweet spot can be made somewhat larger by adding weights to the heel and/or toe. As shown in FIG. 1A, a line 20 passing through the center of mass 18 and extending parallel to the centerline 17 of the shaft has a substantial lateral offset distance 21. Not only is the mass center offset laterally as shown in FIG. 1A, it is offset toward the rear surface of the club head 10 by a distance 22 as shown in FIGS. 1B and 1C. As a result, there is a moment arm 23 shown in FIG. 1C of substantial length between the centerline 17 of the neck 12 and the center of mass 18 of the club head 10. The existence of the arm 23 dictates that when the hitting face 19 impacts the golf ball, even in the sweet spot area, the reaction impact force applies a torque to the club head 10 about the centerline 17 of the neck 12. This force tends to cause the club head 10 to rotate clockwise, as viewed from above, and the hitting face 14 ot "open" as previously described. Moreover, as the club head 10 is accelerated downward during the golfer's swing, the club face 14 will tend to open somewhat because the head 10 is very massive compared to the shaft. Any opening of the hitting face may cause the golf ball to be "sliced" because of clockwise rotation impacted thereto at the instant of impact. To compensate, the golfer may employ a grip and otherwise grasp the shaft in such a way that the point of intersection of the lines 23 and 22 leads the point of intersection of the lines 23 and 21.

Referring now to FIG. 2, a preferred embodiment of the present invention is shown. The body 30 of the club head 31 has basically a spherical shape with an arm 32 extending radially outward thereof. A bore 33 is formed in the arm 32, and preferably is extended to a point 34 that coincides with the geometric center of the spherical body 30. The bore 33 receives the lower portion of the club shaft (not shown) which is secured therein in any suitable manner. The arm 32 is radiused outward as indicated at 35 to provide a smooth transition with the outer surface 36 of the spherical body 30.

Figure 4:
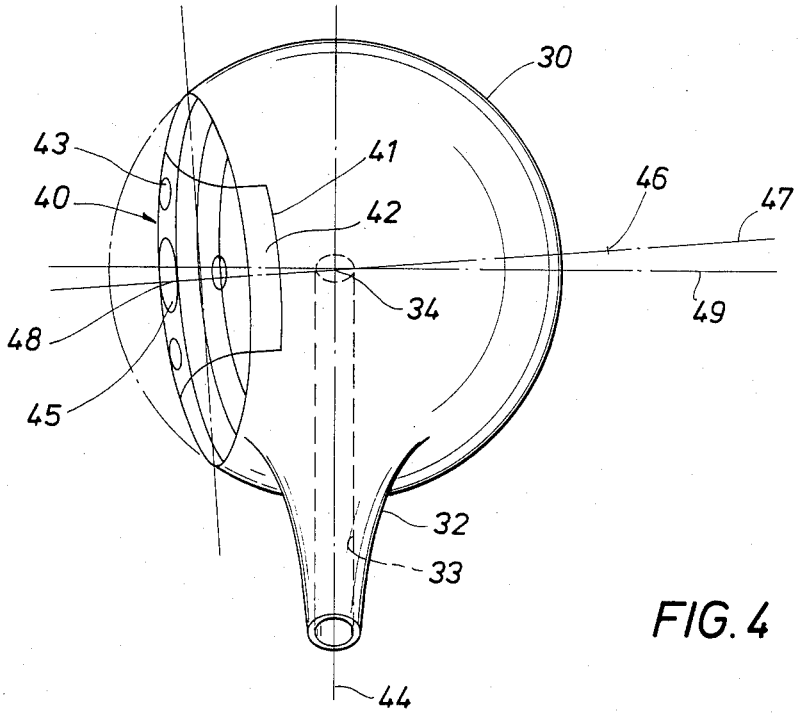
FIG. 4 is a top view of the club head of the present invention.

In the manufacture of the club head 31, a lower portion of the body 30, indicated in phantom lines in FIG. 2, is removed to provide a planar, or very slightly curved, lower surface 37 to which a sole plate 38 is attached. The sole plate 38 forms an angle with respect to the axis of centerline 44 of the bore 33 of about 50° as shown in FIG. 2, or such other angle as may be chosen for a particular golfer. With reference to FIGS. 2, 4 and 5, it will be seen that a front portion of the body 30 indicated in phantom lines also is removed to provide for a hitting face 40. A recess 41 is formed in the face 40 and receives an insert 42 which is secured to the face by several screws 43. The insert 42 can be provided with a decorative circular piece 45 that is centered in the hitting area directly in front of the point 34.

The axis 44 of the arm bore 33 is made to pass through the geometric center 34 of the spherical body 30. Ordinarily the center point 34 will correspond substantially to the center of mass of the body 30. In this manner, there is no offset as with prior designs as described above, which alleviates tha attendant problems. Since the center of mass of the body 30 effectively lies on the shaft axis 44, there is no substantial tendency of the club head to rotate at impact with the ball or during the swing. It has been found that the club face 40 of the present invention has a larger sweet spot area than is found in conventional club head designs.

In accordance with a further feature of the present invention, the outer surface of the insert 42, and the balance of the exposed area of the hitting face 40, are provided with a unique shape. As shown in FIG. 4, the shape of the face is defined by a combination of vertical and horizontal curves that provide an extreme outward bulge compared to prior devices. In a horizontal plane in the region of the sweet spot, the outline of the insert 42 is defined by a six inch diameter circle centered at point 46 on a line 47 that passes through the geometric center 34 of the body 30 and the center point 48 of the insert 45. The line 47 can be at a small acute "hook" angle with respect to a line 49 that is orthogonal to the shaft axis 39 (for example 5°) however, such angle is not necessary. The line 49 defines the theoretical flight of a golf ball impacted by the outer surface of the insert 42. Formation of the outer surface on a six inch diameter circle as described results in an approximate 30% increase in any horizontal bulge for a driver of which applicant is aware.

In a vertical plane in the region of the insert 45, the outline of the outer face of the hitting area is defined by 4.75 inch diameter arc centered at a point 50 on a line 51 that passes through the geometric center 34 of the body 30. The line 51 is at a right angle to a line 52 which defines the general loft angle "L" (FIG. 5) of the club with respect to vertical. This angle is variable with the number of the wood, and for example can be 11°, 14°, 17°, 20° and 22° for the respective 1 through 5 woods. The formation of the vertical curve of the front face on the arc described above results in an approximate 70% increase over the vertical roll used in any previous club head design of which applicant is aware.

The increases in both horizontal bulge and vertical roll provide an extreme roundness of the hitting face 40. Applicant has found that this feature dramatically reduces the instances of inadvertently pushed or pulled shots where the arc of movement of the club head during the swing is not perfectly in line with the desired direction of ball flight.

In order to form a club head 31 that is shaped in accordance with the present invention, a block of wood (preferably persimmon) of correct size is turned on a lathe until it has the approximate shape of a sphere having a tapered arm 32 on one side. Of course the present invention is not limited to wood as a material, and the head could be formed by various casting or molding procedures. The arm 32 and body 30 then are bored to the depth of the geometric center 34 of the sphere on a line 44 that corresponds to the centerline of the arm. The bore 33 thus formed receives the lower portion of the shaft, there being no offset between the shaft axis 44 and the center of mass 34 of the body 30.

A lower portion of the spherical body 30 is removed by cutting to provide the sole surface 37, extending in a horizontal plane that typically is at a 50° angle with respect to the arm axis 44, although this angle can vary somewhat for different golfers. A frontal portion of the body 30 is removed by cutting to provide a plane surface that can have a slight hook angle of about 5° as previously described, although such angle is not necessary. The surface is provided with a loft angle depending upon the number of the resulting wood. At this point in the manufacture, the frontal face of the club head 31 is substantially flat.

A recess 41 is routed out in the front face to receive the hitting insert 42, and such insert is attached by screws 43 or the like. The front face 40 of the insert 42, and the remaining outer surfaces immediately adjacent the insert, then are rounded in accordance with the present invention to provide an extreme bulge as described herein. Finally a recess 37 is routed in the lower surface of the body 30 to receive the sole plate 38, which also is attached by screws or the like. The sole plate 38 can be flat, or can be slightly curved in the fore and aft directions if desired. The resulting club head 31 then is finished by staining or painting and varnishing. The head 31 is securely attached to the club shaft in a suitable manner, such as by glue and a lock screw.

It now will be recognized that a new and improved wood-type club head has been dislcosed. The elimination of any offset reduces the instances of hooked or sliced golf shots, and the extreme bulge of the club face reduces the instances of pushed or pulled shots. Although various materials have been disclosed by which the body, hitting insert, and sole plate can be made, such examples are to be considered as illustrative and not in a limiting sense. Since certain changes or modifications may be made in the disclosed embodiment without departing from the inventive concepts of the present invention, it is the aim of the appended claims to cover all such changes and modifications falling with the true spirit and scope of the present invention.

What is claimed is:

1. A wood-type head for a golf club having a center-shaft design, comprising: a body having a generally spherical shape, said body being formed with an integral arm extending radially outward of the center of said body, said arm having a bore extending therethrough and into said body along an axis in a vertical plane that passes through said center of said body, said bore being adapted to receive the shaft of the golf club, said body having a hitting face formed on the front side thereof, said face being inclined upward and rearward with respect to said vertical plane said face being shaped such that its outline in a vertical plane perpendicular to a line passing through said center is a convex arc to provide vertical roll, and such that its outline in a horizontal plane passing through said center is a convex arc to provide horizontal bulge, the degree of curvature of said arc in said vertical plane being greater than the degree of curvature of said arc in said horizontal plane.

2. The head of claim 1 wherein a sole surface is provided on the lower side of said body, said surface being inclined at an angle with respect to the said axis of said arm.

3. The head of claim 3 further including a plate substantially covering said sole surface.

4. The head of claim 1 further including an insert mounted in said body and forming a majority of the surface area of said face.

5. A center-shafted wood-type head for a golf club, comprising: a generally spherical body having a center; an arm formed integral with said body and extending outwardly along an axis in a vertical plane that passes through said center; a bore in said arm adapted to receive the lower end portion of a shaft; a hitting surface formed on the front face of said body, said surface being inclined upward and rearward at an angle of from about 11° to 22° with respect to said vertical plane, said surface having an outline defined by convex arcs in both the vertical and horizontal planes to provide an outwardly bulged shape, the radius of curvature in said vertical plane being shorter than the radius of curvature in said horizontal plane, said first-mentioned radius extending from a horizontal axis that passes through a portion of said body, said second-mentioned radius extending from a vertical axis that lies entirely outside of said body.

6. The head of claim 5 wherein said bore extends throughout the length of said arm and terminates substantially at said center.

7. The head of claim 6 further including a generally planar sole surface formed on the bottom side of said body that extends at an angle with respect to said axis of from about 40° to 60°.

8. The head of claim 7 further including a recess formed in said body generally contiguous with said sole surface; and a sole plate positioned in said recess and secured to said body.

9. The head of claim 6 further including a shaft having its lower end portion received in said bore and secured to said arm and to said body.

10. The head of claim 5 further including a recess in the front side of said body; an insert secured in said recess; and wherein said hitting surface extends entirely over the outer surface of said insert.

11. A method of making a wood-type head for a golf club, comprising the steps of: forming a spherical body having an arm extending radially outward of the center of said body; boring a hole that extends throughout the length of said arm and into said body to approximately the center thereof; forming a sole surface on the lower side of said body, forming a hitting surface on the front side of said body such that said hitting surface has a selected loft angle with respect to vertical; providing a recess in said hitting surface and securing an insert therein; and forming the outer face of said insert to have an outwardly bulged shape having a radius of curvature in a vertical plane that is approximately eight-tenths of the radius of curvature in a horizontal plane, said radius of curvature in said vertical plane extending from a point located within said body rearward of said body center, said radius of curvature in said horizontal plane extending from a point located externally of said body rearward of said body center.

* * * * *